US007490875B2

(12) United States Patent
Najima

(10) Patent No.: US 7,490,875 B2
(45) Date of Patent: Feb. 17, 2009

(54) LOCK SYSTEM

(75) Inventor: Masahiro Najima, Kanagawa (JP)

(73) Assignee: Piolax Inc., Yokohama-shi, Kanagawa (JP)

( * ) Notice: Subject to any disclaimer, the term of this patent is extended or adjusted under 35 U.S.C. 154(b) by 0 days.

(21) Appl. No.: 11/699,435

(22) Filed: Jan. 30, 2007

(65) Prior Publication Data

US 2007/0200361 A1 Aug. 30, 2007

(30) Foreign Application Priority Data

Jan. 31, 2006 (JP) ..... P2006-022863

(51) Int. Cl.
*E05C 3/06* (2006.01)

(52) U.S. Cl. ..... 292/216; 292/201; 292/DIG. 23; 296/37.12

(58) Field of Classification Search ..... 292/216, 292/201, DIG. 23; 296/37.12
See application file for complete search history.

(56) References Cited

U.S. PATENT DOCUMENTS 4,538,843 A * 9/1985 Harris ..... 292/113
4,904,004 A * 2/1990 Bartczak ..... 292/216

FOREIGN PATENT DOCUMENTS

JP 2-43368 3/1990

* cited by examiner

*Primary Examiner*—Patricia Engle
*Assistant Examiner*—Mark Williams
(74) *Attorney, Agent, or Firm*—McGinn IP Law Group, PLLC

(57) ABSTRACT

A lock system includes: a latch which is rotatably supported on a housing, and is brought into engagement with and disengagement from a striker; a spring for biasing the latch in a direction in which the engagement of the latch with the striker is released; a slide member which is rotatably supported on the housing, controls the rotation of the latch, and is an integrated molded part; a rotation preventing portion which prevents a rotation of the latch in a biased direction; a rotation permitting portion which permits the rotation of the latch in the biased direction; and a driven portion which links with a manual operation unit, wherein: the rotation preventing portion and the rotation permitting portion are provided at one end portion of the slide member; and the driven portion is provided at the other end portion of the slide member.

2 Claims, 9 Drawing Sheets

LOCK SYSTEM

BACKGROUND OF THE INVENTION

1. Field of the Invention

The present invention relates to a lock system for locking a glove box itself which is mounted on an instrument panel of a motor vehicle in such a manner as to be opened and closed or an independent lid of the glove box.

2. Description of the Related Art

Although not illustrated specifically, a conventional lock system of this type is made up of a housing which is fixed to a lid side of a glovebox, a latch which is rotatably supported on the housing in such a manner as to be brought into engagement with and disengagement from a striker, a spring for biasing the latch in a direction in which the engagement of the latch with the striker is released, a lock plate with a notched recessed portion which is slidably supported on the housing to control the rotation of the latch, an operation handle having an operation arm on a rear surface thereof, an L-shaped lever which rotates eccentrically by virtue of an operation of a key cylinder, and a connecting rod which connects the lever with the lock plate (refer to, for example, JP-UM-A-2-43368).

Then, in an actual use, when the striker and the latch are in engagement with each other, since a lower end portion of the latch is in abutment with the lock plate against a biasing spring pressure applied thereto by the spring, the glove box or the lid thereof is allowed to remain in a closed state with the latch and the lock plate remaining in the abutment state. When attempting to open the glove box or the lid thereof, a state is firstly realized in which one end portion of the L-shaped lever is made to be positioned below the operation arm of the operation handle by operating the key cylinder, and then, when the operation handle is operated, the one end portion of the lever is pushed downwards by the operation arm, and the lever rotates in a predetermined direction, whereby the lock plate is made to slide by virtue of a tension by the connecting rod, so that the lower end portion of the latch is made to face the notched recessed portion of the lock plate. As a result, the latch is then allowed to rotate in the direction in which the engagement of the latch with the striker is released by virtue of the biasing spring pressure applied to the latch by the spring, whereby the glove box or the lid thereof is opened.

SUMMARY OF THE INVENTION

Consequently, although the conventional lock system has an advantage that the glove box or the lid thereof can be opened and closed only by controlling the rotation of the latch against the biasing spring pressure applied thereto and releasing the engagement of the latch with the striker by virtue of the biasing spring pressure applied thereto, due to the reason that the lock plate supported on the housing is connected with the L-shaped lever which makes up an opening/closing operation portion via the connecting rod, these three component parts oscillate freely, and therefore, there has occurred a case where the postures of the component parts relative to each other are changed during transportation. Due to this, since the relevant component parts get entangled with other parts to such an extent that the disentanglement thereof from the other parts becomes impossible or the postures of the three component parts have to be realigned properly when they are assembled on to the glove box side, the assembling work tends to become difficult to be carried with producing nothing in return.

The invention is developed with a view to solving effectively the problem inherent in the conventional lock system, and according to a first aspect of the invention, there is provided a lock system including: a latch which is rotatably supported on a housing, and is brought into engagement with and disengagement from a striker; a spring for biasing the latch in a direction in which the engagement of the latch with the striker is released; a slide member which is rotatably supported on the housing, controls the rotation of the latch, and is an integrated molded part which is molded from a synthetic resin; a rotation preventing portion which prevents a rotation of the latch in a biased direction; a rotation permitting portion which permits the rotation of the latch in the biased direction; and a driven portion which links with a manual operation unit, wherein: the rotation preventing portion and the rotation permitting portion are provided at one end portion of the slide member; and the driven portion is provided at the other end portion of the slide member.

According to a second aspect of the invention, there is provided the lock system according to the first aspect of the invention, further including an elastic locking portion which can be inserted into an insertion hole in the housing but which prevents a dislodgement thereof in an opposite direction, wherein the elastic locking portion is provided at the one end portion of the slide member.

According to a third aspect of the invention, there is provided the lock system according to the second aspect of the invention, further including: an elastic arm which is partially cut apart from the one end portion of the slide member; an arc-shaped guide surface relative to the insertion hole; and a vertical lock surface having an upwardly tapered shape, wherein: the elastic locking portion includes the elastic arm; a front end edge of the elastic arm is made to make up the arc-shaped guide surface; and the vertical lock surface is formed at a rear end edge of the elastic arm.

According to a fourth aspect of the invention, there is provided the lock system according to any of the first to third aspects of the invention, wherein the rotation permitting portion of the slide member exhibits a notched recess shape; and a circumferential edge of the notched recess shape exhibiting rotation permitting portion which lies on a side facing the rotation preventing portion is smaller in height than a protecting height of an external boundary wall which extends from the vicinity of the rotation preventing portion to the notched recess shape.

According to a fifth aspect of the invention, there is provided a lock system as set forth in any of the first to fourth aspects of the invention, wherein the slide member is molded into a beam shape which exhibits a substantially rectangular cross section; and the cross section is twisted midway along the length thereof in such a manner that the cross section in the vicinity of the rotation preventing portion is twisted in a direction in which the latch rotates from a released state to a locked state relative to the cross section in the vicinity of the driven portion.

Consequently, due to the reason that the slide member which connects the housing side which includes the latch and the spring to the manual operation unit side is molded into the molded part from the synthetic resin, since the housing side and the slide member side oscillate in no case freely relative to each other, it is possible to eliminate the situation where the relative postures of the component parts are changed during transportation, which is inherent in the conventional lock system. Consequently, there occurs no case where the component parts get entangled with other parts to such an extent that the disentanglement thereof from the other part becomes impossible or the component parts have to be realigned properly when they are assembled on to the glove box side, thereby making it possible to facilitate remarkably the assembling work of the component parts on to the lid of the glove box.

In the second aspect of the invention, since there occurs no inadvertent separation of, in particular, the housing and the slide member due to the existence of the elastic locking portion, the handling, transportation and assembling of the housing and the slide member on to the lid becomes convenient remarkably.

In the third aspect of the invention, the assembling of the housing and the slide member is facilitated by the guide surface of the elastic arm, and the separation of the housing and the slide member can be prevented in a more ensured fashion by the vertical lock surface.

In the fourth aspect of the invention, since the rotation permitting portion of the slide member exhibits the notched recess shape and the circumferential edge of the rotation permitting portion which lies on the side facing the rotation preventing portion is made to be smaller in height than the projecting height of the external boundary wall which extends from the vicinity of the rotation preventing portion to the notched recess shape, the stable sliding of the slide member is ensured while securing the continuity on the one end portion side of the slide member, thereby making it possible to cause the abutment lower end portion of the latch to be translated smoothly into the rotation permitting portion which exhibits the notched recess shape.

In the fifth aspect of the invention, since the cross sectional shape of the slide member is twisted midway along the length thereof, the latch can be made smaller in size and lighter in weight, and although it is light in weight, the slide member can obtain a high rigidity and the sliding support, thereby making it possible not only to enhance the operation feeling of the lock system but also to reduce the thickness of the lid of the glove box.

BRIEF DESCRIPTION OF THE DRAWINGS

These and other objects and advantages of this invention will become more fully apparent from the following detailed description taken with the accompanying drawings in which.

DETAILED DESCRIPTION OF THE EMBODIMENTS

The invention is such as to particularly enable a lock system for a glove box or a lid thereof to be made up into a module so as to facilitate the assemblage of the lock system to a lid of a glove box by providing a lock system including a latch which is rotatably supported on a housing in such a manner as to be brought into engagement with and disengagement from a striker, a spring for biasing the latch in a direction in which the engagement of the latch with the striker is released, and a slide member which is rotatably supported on the housing in such a manner as to control the rotation of the latch, wherein the slide member is an integrated molded part which is molded from a synthetic resin and has provided at one end portion a rotation preventing portion which prevents a rotation of the latch in a biased direction and a rotation permitting portion which permits the rotation of the latch in the biased direction and provided at the other end portion thereof a driven portion which links with a manual operation unit.

Figure 1:
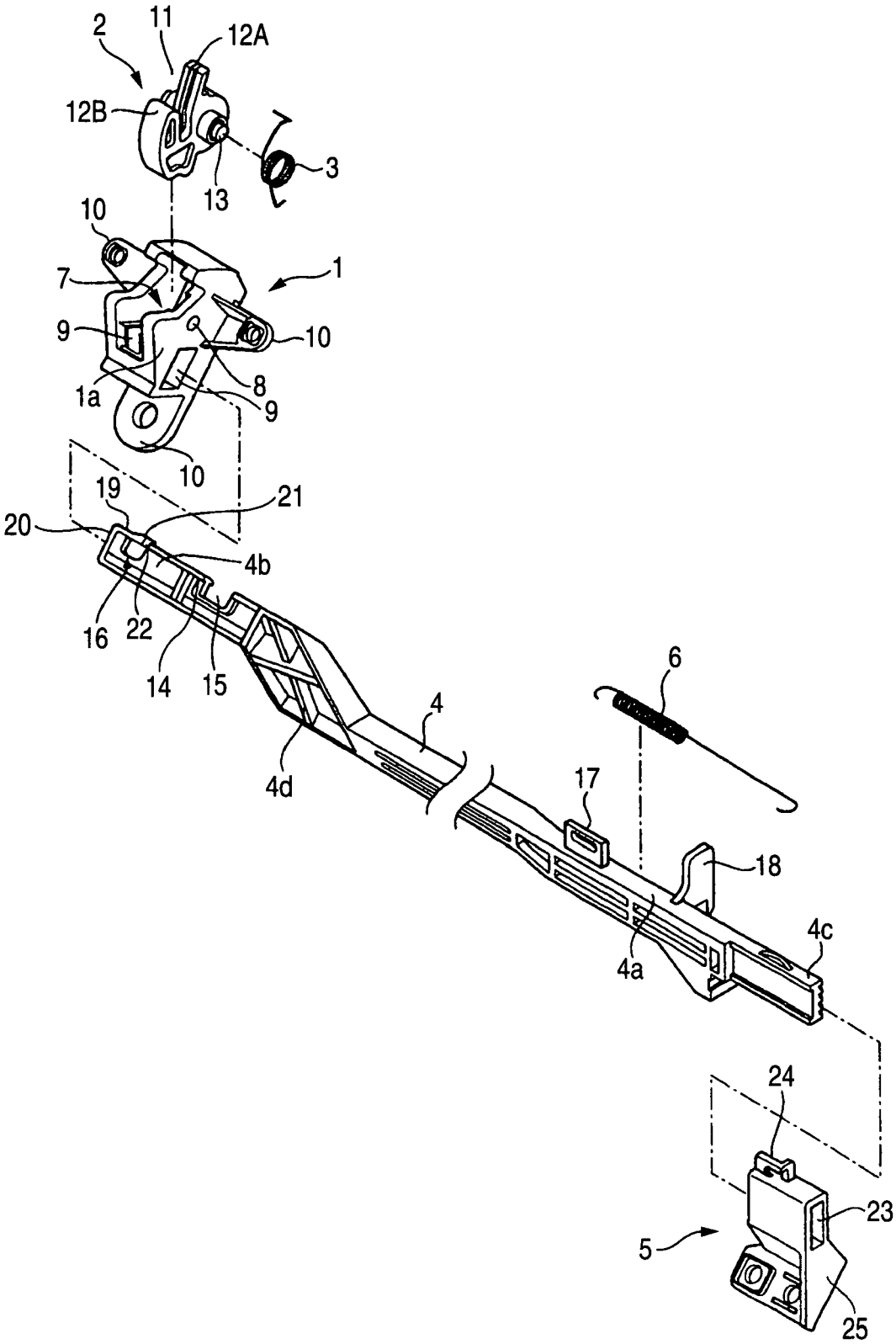
FIG. 1 is a perspective view showing a lock system according to an embodiment of the invention in an exploded fashion.

Hereinafter, the invention will be described in detail based an a preferred embodiment thereof which is illustrated in the accompanying drawings. As with the conventional lock system, a lock system of this embodiment is such as to have been developed to lock a glove box itself which is mounted in an instrument panel of a motor vehicle in such a manner as to be opened and closed or an independent lid thereof and is, as shown in FIG. 1, made up of a housing 1 which is fixed to a lid side of the glove box, a latch 2 which is rotatably supported on the housing 1 in such a manner as to be brought into engagement with and disengagement from a striker, a helical torsion coil spring 3 for biasing the latch 2 in a direction in which the engagement of the latch 2 with the striker is released, a slide member 4 which is slidably supported on the housing as one end portion thereof in such a manner as to control the rotation of the latch 2, a guide 5 which is fixed to the lid side of the glove box in such a manner as to support slidably the other end portion of the slide member 4 and a return spring 6 in the form of a helical tension coil spring which is mounted between the guide 5 and the slide member 4 to bias the slide member 4 in a direction towards the guide 5.

Figure 2A:
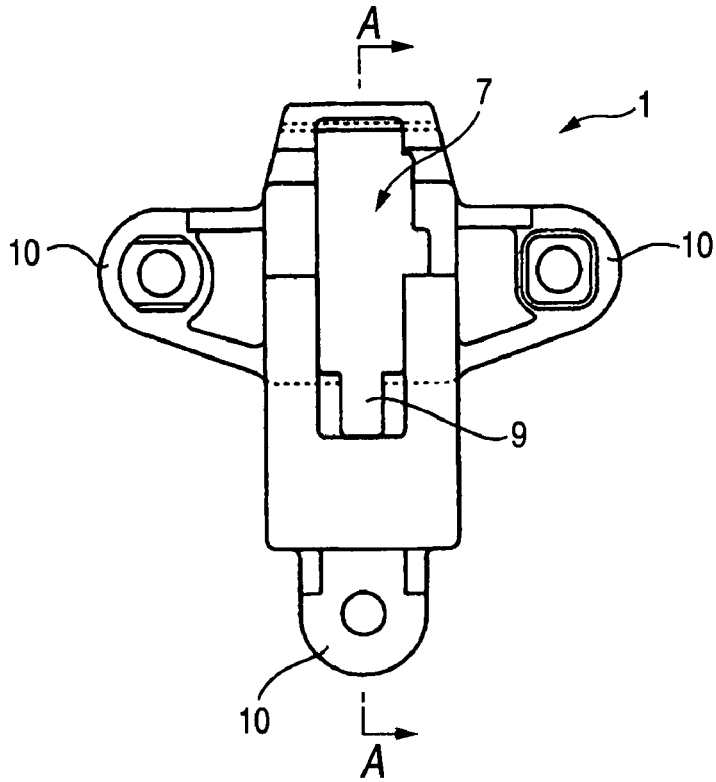
FIG. 2A is a front view showing a housing.
Figure 2B:
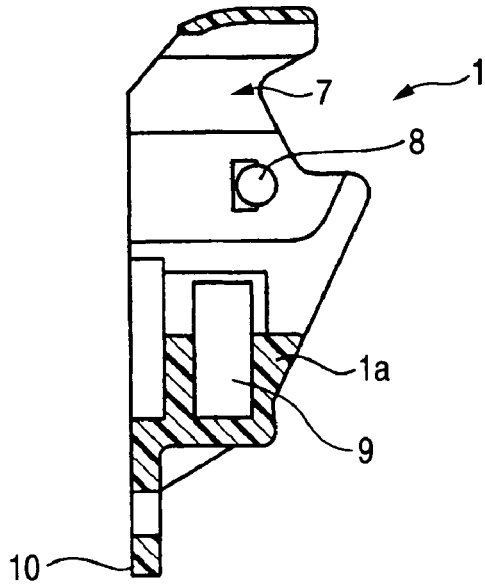
FIG. 2B is a sectional view taken along the line A-A in FIG. 2A.

In addition, as is also shown in FIGS. 2A and 2B, the housing 1 is constructed as follows. Namely, a space 7 for accommodating therein the latch 2 rotatably is defined in a central portion of a box-shaped base body la of the housing 1. Additionally, a pair of bearing portions 8 are formed in both sides of the box-shaped base body 1*a* which define the space 7, and an insertion hole 9 into which a one end portion side of the slide member 4 is inserted is formed in a lower portion of the box-shaped base body 1*a* in such a manner as to communicate with the space 7. Moreover, a plurality of mounting pieces 10 are provided integrally on an outer circumference of the box-shaped base body 1*a* in such a manner as to protrude therefrom.

Figure 3:
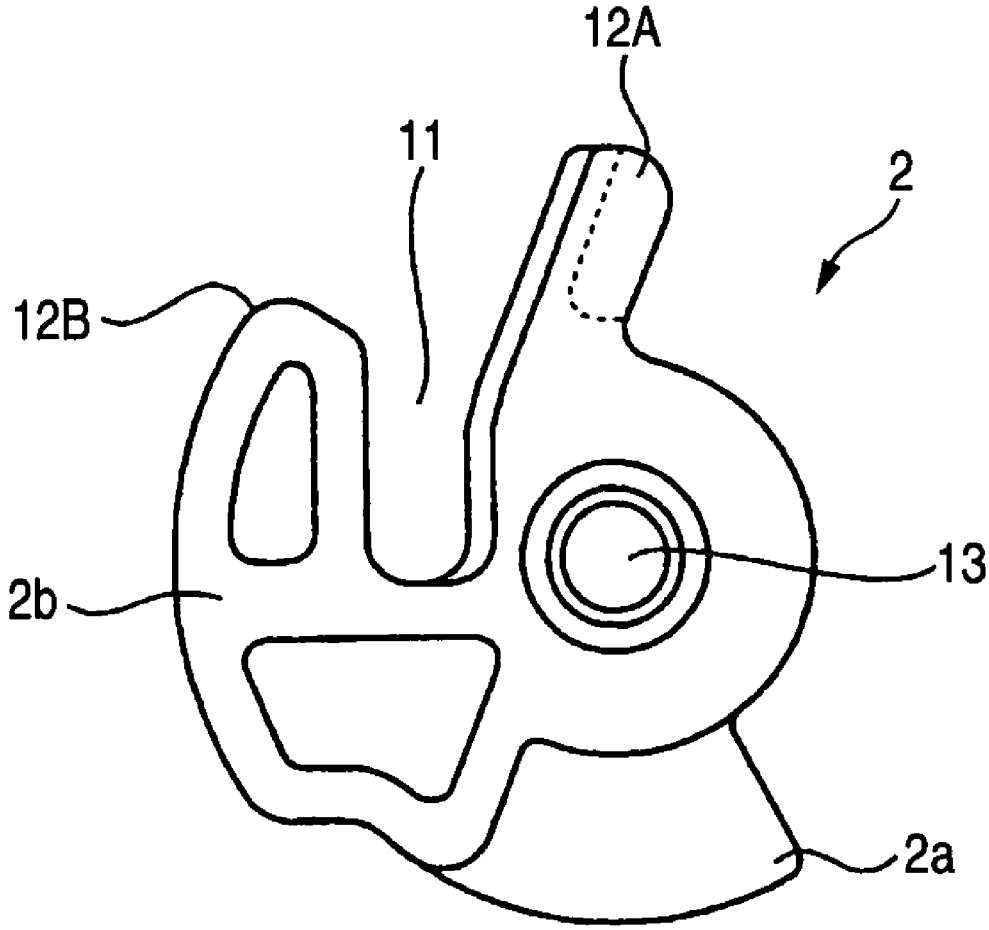
FIG. 3 is a side view showing a latch.

As is also shown in FIG. 3, the latch 2 is constructed as follows. Namely, the latch 2 has bifurcated tongue pieces 12A, 12B which define an engagement groove 11 which is brought into engagement with the striker, and a pair of shaft portions 13 are formed at central portions on both sides of the latch 2 in such a manner as to be fitted in the bearing portions 8, respectively. The helical torsion coil spring 3 is mounted on one of the shaft portions 13, whereby the latch 2 is biased at all times in a direction in which the engagement thereof with the striker is released. In addition, an abutment lower end portion 2*a*, which will be described later on, is positively formed on the latch 2 in such a manner as to be brought into abutment with a rotation preventing portion 14 of the slide member 4.

Figure 4A:
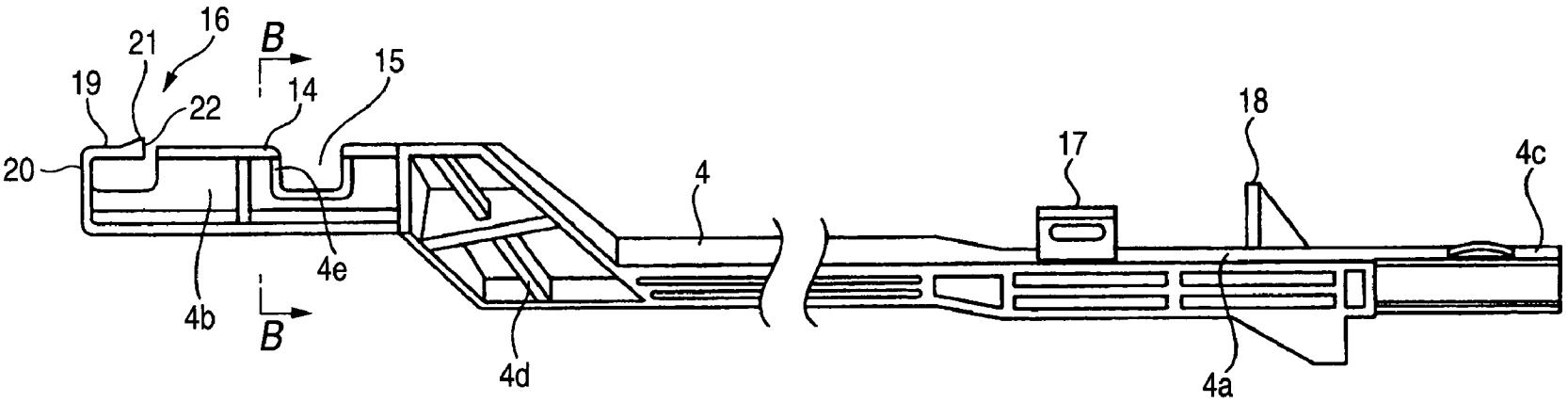
FIG. 4A is a front view showing a slide member.
Figure 4B:
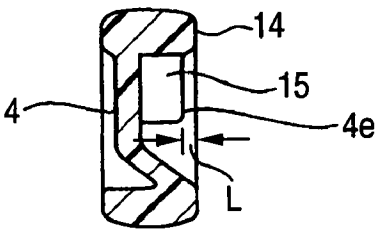
FIG. 4B is an enlarged sectional view taken along the line B-B in FIG. 4A.

As is also shown in FIGS. 4A and 4B, the slide member 4 is constructed as follows. Namely, the slide member 4 is an integrated molded part, which is molded from a synthetic resin into a beam-like shape as a whole which has a substantially rectangular cross section and which is twisted midway along the length thereof. The wall-shaped rotation preventing portion 14 which prevents the rotation of the latch 2 in a direction in which the latch 2 is biased by the spring 3 and a notched recess-shaped rotation permitting portion 15 which permits the rotation of the latch 2 in the biased direction are continuously provided on the one end portion side of the slide member 4, and an elastic locking portion 16, which can be inserted into the insertion hole 9 in the housing 1 but which prevents a dislodgement thereof in an opposite direction, is provided at a position which lies more distal than the rotation preventing portion 14, whereas there are provided on the other end portion side of the slide member 4 a hook portion 17 on which one end of the return spring 6 is hooked and a flat-shaped driven portion 18 which links up with a manual operation unit provided on the lid of the glove box is provided on the other end portion side of the slide member 4.

In addition, as is shown in the figure, the elastic locking portion 16 is constructed as follows. Namely, the elastic locking portion 16 has an elastic arm 19 which is partially cut apart from the one end portion side of the slide member 4 by cutting out a portion of the slide member 4 which lies on a back side of the elastic arm 19, and a front end edge of the elastic arm 19 is made into an arc-shaped guide surface 20 relative to the insertion hole 9, a vertical lock surface 22 having an upwardly tapered shape being formed at a rear end edge of the elastic arm 19, whereby when inserting the elastic arm 19 into the insertion hole 9, the insertion is facilitated by being guided by the guide surface 20, and in a midway stage of the insertion, the lock surface 22 is deflected by the action of the upwardly tapered shape 21 so as to enable the passage of the lock surface 22 through the insertion hole 9. On the contrary, when the one end portion side of the slide member 4 is about to be dislodged from the insertion hole 9 in the housing 1, the vertical lock surface 22 is brought into abutment with a hole edge of the insertion hole 9, so as to prevent the dislodgement of the slide member 4.

In addition, the rotation permitting portion 15 of the slide member 4 which exhibits the notched recess shape is, as shown, in particular, in FIG. 4B, set such that a circumferential edge 4*e* thereof which lies on a side facing the rotation preventing portion 14 is made slightly smaller in height by an amount L than a projecting height of an external boundary wall which extends from the vicinity 4*b* of the rotation preventing portion 14 to the notched recess shape, whereby a stable sliding of the slide member 4 is ensured while securing the continuity of the one end portion side of the slide member 4, so as to allow the abutment lower end portion 2*a* of the latch 2 to be translated smoothly into the rotation permitting portion 15 which exhibits the notched recess shape.

As is shown in FIG. 1, the guide 5 is constructed as follows. Namely, an insertion hole 23 is formed in an upper portion side of the guide 5 into which the other end portion of the slide member 4 is inserted, and a hook portion 24 is provided thereon on which the other end portion of the return spring 6 is hooked, a mounting piece 25 being integrally provided on a lower portion side of the guide 5 in such a manner as to extend therefrom.

Figure 5:
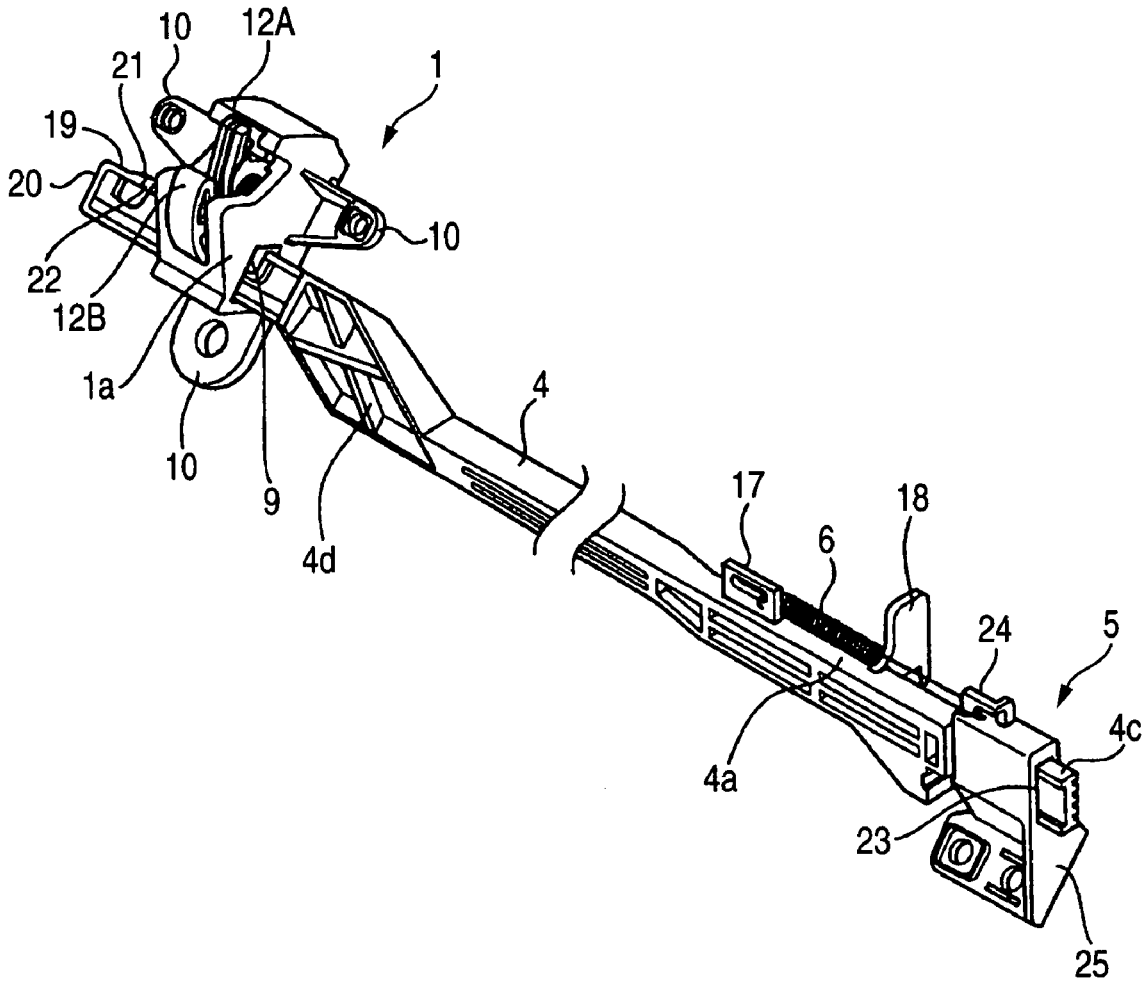
FIG. 5 is a perspective view showing an assembled state.

Consequently, when locking the glove box or the lid thereof with the lock system that is configured as has been described heretofore, firstly, the one end portion side of the slide member 4 is inserted into the insertion hole 9 in the housing 1 via the elastic locking portion 16 in such a state that the latch 2 is rotatably supported on the housing 1 side via the spring 3, and after the other end portion of the slide member 4 is inserted into the insertion hole 23 in the guide 5, the return spring 6 is mounted to extend between the hook portion 24 on the guide 5 and the hook portion 17 on the slide member 4, whereby as is shown in FIG. 5, the lock system itself is fabricated simply into a module. Thus, although not illustrated specifically, thereafter, the respective mounting pieces 10, 25 of the housing 1 and the guide 5 only have to be fixed to the lid side of the glove box for use as the lock system of the glove box or the lid thereof.

In this case, however, since the slide member 4 which connects the housing side 1 including the latch 2 with the spring 3 and an operation handle side is molded integrally from the synthetic resin, there is eliminated the case where the housing 1 side and the slide member 4 side oscillate freely and independently, which is inherent in the conventional lock system, whereby the case can be eliminated where the postures of the relevant component members relative to each other are changed during transportation. Consequently, the possibility is eliminated that the housing 1 including the latch 2 and the spring 3 and the slide member 4 get entangled with other parts during transportation due to the free and independent oscillations thereof to such an extent that they cannot get disentangled easily, or in assembling the lock system so fabricated on to the glove box side, the postures of the relevant component parts do not have to be realigned properly, thereby making it possible to facilitate the assembling work of the lock system on to the lid side of the glove box.

Figure 6:
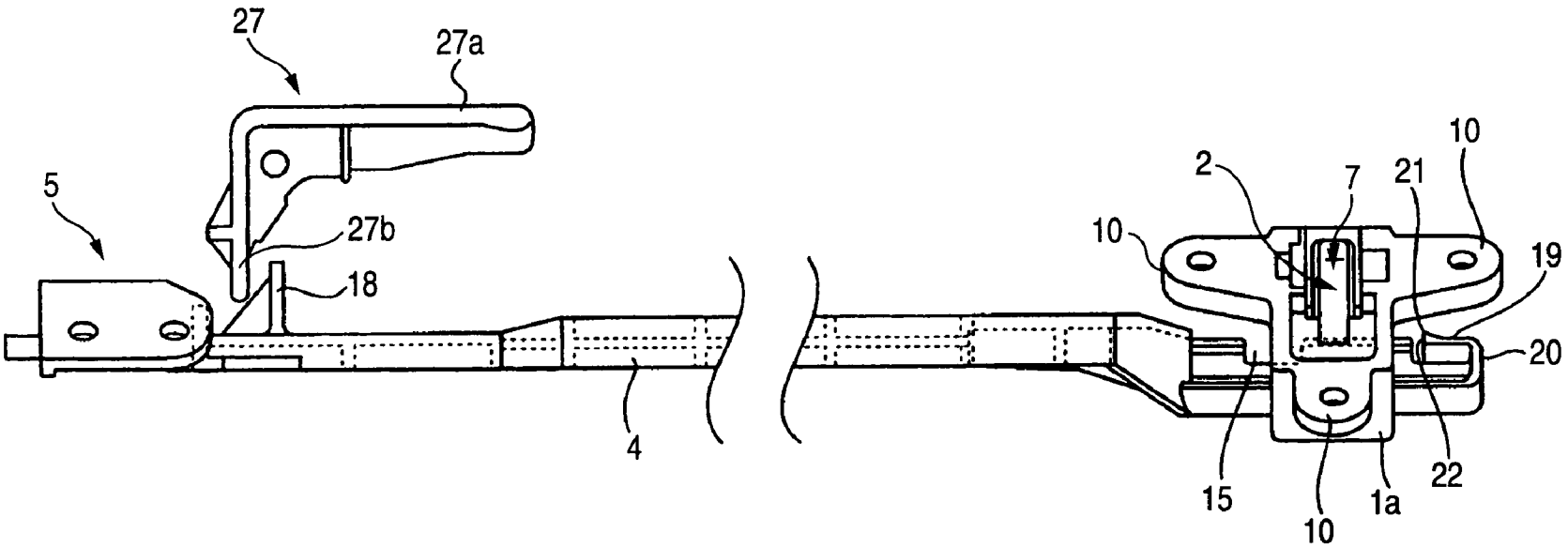
FIG. 6 is an explanatory diagram showing a closed state of a lid.
Figure 7:
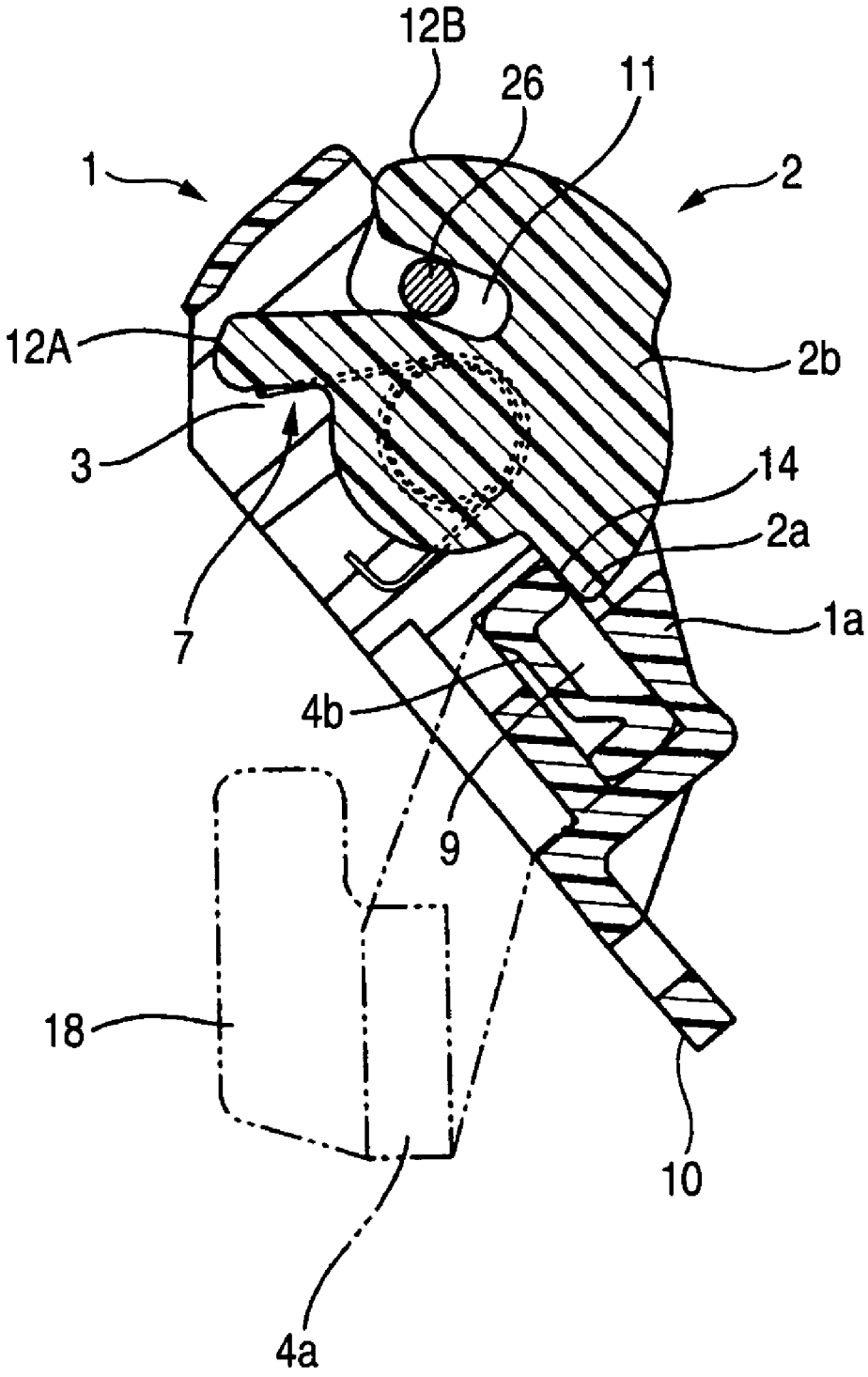
FIG. 7 is a sectional view of a main part of the lock system in the closed state of the lid.

Then, with the lid of the glove box closed, as is shown in FIGS. 6, 7, the latch 2 is in such a state that a striker 26 is in engagement with the engagement groove 11 in the latch 2, and in this state, the abutment lower end portion 2*a* of the latch 2 is in abutment with the wall-shaped rotation preventing portion 14 which is provided on the one end portion side of the slide member 4, so that the latch 2 is prevented from rotating in the direction in which the engagement of the latch 2 with the striker 26 is released by virtue of the spring pressure of the spring 3, whereby the lid of the glove box is locked in the closed position in an ensured fashion.

Figure 8:
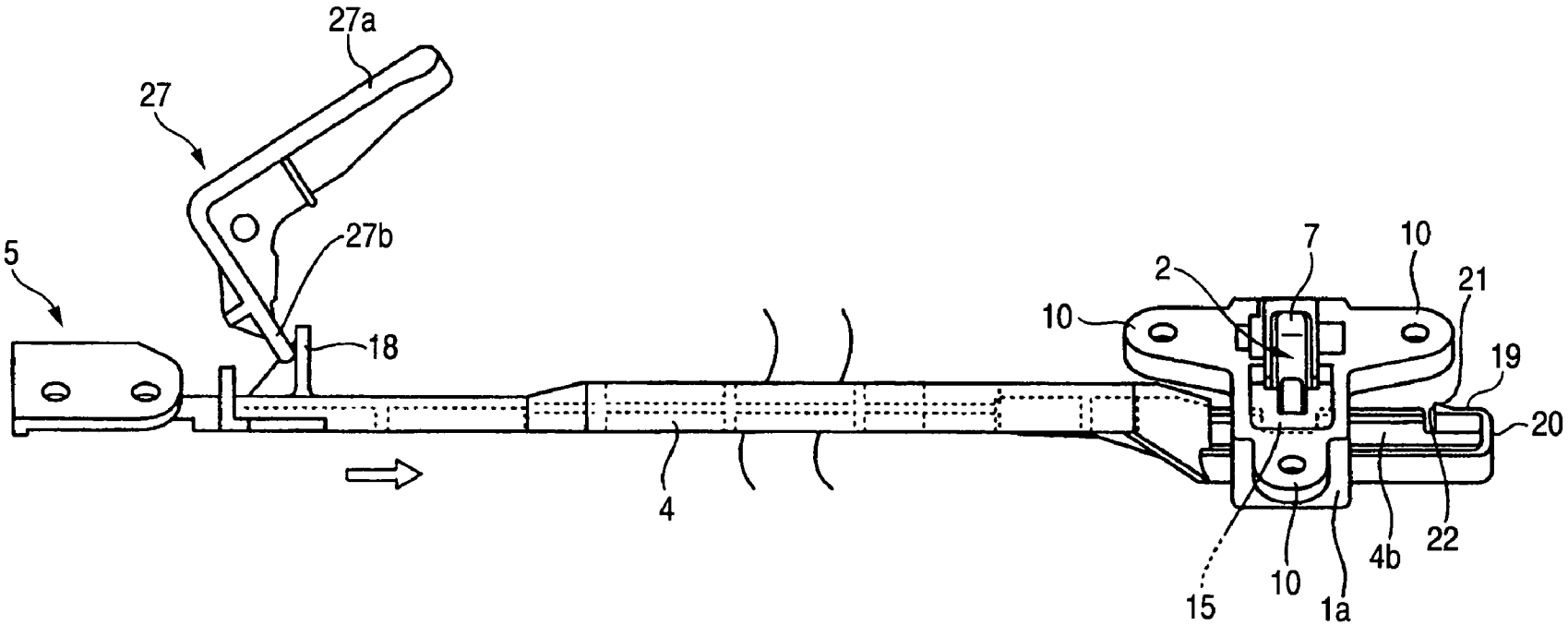
FIG. 8 is an explanatory diagram showing an opened state of the lid.
Figure 9:
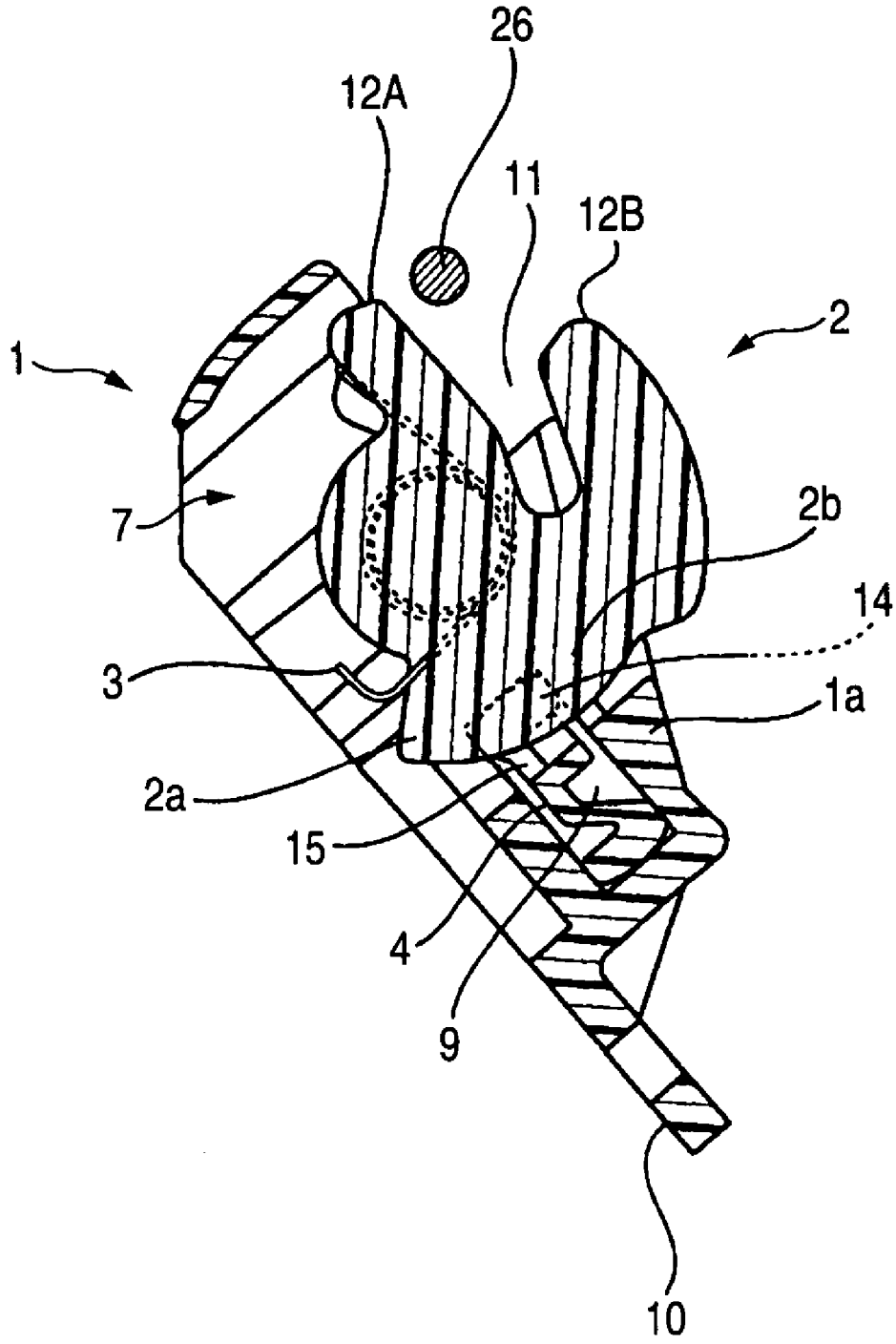
FIG. 9 is a sectional view of the main part of the lock system in the opened state of the lid.

On the contrary, when the closed state is released, the driven portion 18 of the slide member 4 is made to be pushed by a push portion 27*b* of an operation handle 27 by operating an operation portion 27*a* of the operation handle 27, so as to cause the slide member 4 to slide in a direction towards the housing 1 against the spring pressure of the return spring 6. Then, as is shown in FIGS. 8, 9, the notched recess-shaped rotation preventing portion 15 of the slide member 4 is made to coincide in position with the abutment lower end portion 2*a* of the latch 2, whereby the prevention of the rotation of the latch 2 by the rotation preventing portion 14 is released, and the latch 2 rotates by virtue of the spring pressure of the spring 3 in the direction in which the engagement thereof with the striker 26 is released. As a result, the lid of the glove box is permitted to move in an opening direction. Note that in this state, since the abutment lower end portion 2*a* of the latch 2 stays within the notched recess-shaped rotation preventing portion 15, the slide member 4 is locked in the resulting position.

When the lid of the glove box is rotated in a closing direction in the aforesaid state, the striker 26 is brought into abutment with the tongue piece 12A of the latch 2, so as to rotate the latch 2 in a direction in which the striker 26 is brought into engagement with the engagement groove 11 against the biasing spring pressure of the spring 3, whereby the abutment lower end portion 2*a* of the latch 2 is dislodged from the notched recess-shaped rotation permitting portion 15. Then, since the slide member 4 is automatically restored to its original position by virtue of the spring pressure of the return spring 6, the abutment lower end portion 2*a* of the latch 2 is brought into abutment with the rotation preventing portion 14 of the slide member 4 again, whereby since the rotation of the latch 2 is prevented instantly, a closed state of the lid of the glove can result.

To describe this in detail, as is clear from FIGS. 7 and 9, the latch 2 is elastically biased from its locked state (FIG. 7) to its released state (FIG. 9) by virtue of elastic biasing by the spring 3, and without the control by the slide member 4, the latch 2 rotates in a clockwise direction as viewed in FIG. 7 to be put in the released state. In addition, when the slide member 4 slides in a longitudinal direction thereof so that the abutment lower end portion 2*a* of the latch 2 is allowed to enter the interior of the notched recess shape of the rotation permitting portion 15, the latch 2 is allowed to be in the released state, and as this occurs, although the slide member 4 is biased by the return spring 6, an edge of the notched recess shape of the rotation permitting portion 15 is in abutment with a side surface of the abutment lower end portion 2*a* of the latch, whereby a state results in which a further slide of the slide member 4 is not permitted.

On the other hand, when the latch 2 is rotated from the released state in a counterclockwise direction as viewed in FIG. 9 (this is caused when the tongue piece 12A of the latch 2 is pushed in relative to the striker 26 which is disposed on a vehicle body side by the action to close the lid), the abutment lower end portion 2*a* of the latch 2 is completely dislodged from the rotation permitting portion 15 of the slide member 4, whereby the slide member 4 is caused to slide by the return spring 6 so that the rotation preventing portion 14 and the vicinity 4*b* thereof which exhibits the substantially rectangular cross section are made to enter the interior of the insertion hole 9. As a result, the closing operation of the lid is completed, and even though the latch 2 is attempted to be biased again by the spring 3 in the direction in which the engagement thereof with the striker 26 is released, the abutment lower end portion 2*a* of the latch 2 is in abutment with the rotation preventing portion 14 of the slide member 4, and thereby the latch 2 cannot rotate in the direction in which the released state can result, and therefore, the locked state is maintained.

In this locked state, in addition to a moment produced by the biasing force of the spring 3, a moment produced by the gravity of the lid to open it is also exerted to the latch 2. The force or moment produced by the gravity of the lid to open it increases as the size and mass of the lid increase, and in a lid of a type in which the lid rotates integrally with a glove box main body, since a quite large moment value results due to the quantity of goods to be accommodated in a glove box, a quite large load is to be applied to the rotation preventing portion 14 of the slide member 4 which prevents the rotation of the latch 2.

Although the slide member 4 is inserted into the insertion hole 9 in the housing 1 at the one end portion and into the insertion hole 23 in the guide 5, in the state in which the lid is closed (when this state results, the latch 2 is in the locked state), the rotation preventing portion 14 is in abutment with the abutment lower end portion 2*a* of the latch 2 which is disposed in the space 7 in the housing 1 to thereby prevent the rotation of the latch 1 in the direction which realizes the released state.

Next, when the occupant operates the operation handle 27 with his or her fingers so as to pull the operation portion 27*a* at the one end portion of the operation handle 27, the operation handle 27 rotates about a fulcrum, whereby the push portion 27*b* at the other end portion of the operation handle 27 pushes on the driven portion 18 on the slide member 4 in a direction towards the latch 2, and as this occurs, the slide member 4 slides while kept in abutment with the abutment lower end portion 2*a* of the latch 2 due to the large load. Therefore, it becomes important for the slide member 4 to be allowed to slide smoothly.

Here, the slide member 4 exhibits the substantially rectangular cross section in the vicinity 4*a* of the driven portion 18 and a guide shaft portion 4*c*, and the guide shaft portion 4*c* is inserted into the corresponding insertion hole 23 in the guide 5 which has a rectangular cross section when the guide 5 is assembled on to the slide member 4. However, due to the rectangular cross section, the guide shaft portion 4*c* cannot be inserted into the insertion hole 23 at rotational positions less than 180°, and therefore, a fear is small that an error in assemblage occurs, and in the event that a large assemblage error occurs in which the guide 5 is rotated erroneously through 180° in an attempt to be assembled on to the guide shaft portion 4*c*, since the guide 5 is rotated as much as 180° to become upside down vertically, the erroneous state of the guide 5 can easily be confirmed visually or through a touch with the tips of the fingers, thereby making it possible to prevent the erroneous assemblage of the component parts. In addition, the rectangular shapes of the guide shaft portion 4c and the insertion hole 23 prevent the rotation of the guide 5, and the guide 5 is slidably supported in a stable fashion by individual sides of the rectangular sliding surfaces. Furthermore, the vicinity 4*a* of the driven portion 18 is also formed to have a rectangular cross section and is disposed such that a side which follows the surface of the lid takes up a long side while a side which follows a thickness direction of the lid makes up a short side of the rectangular cross section, whereby a high operation rigidity during a locking operation can be secured while reducing the thickness of the lid, thereby making it possible to exhibit a high-quality touch.

On the other hand, the vicinity 4*b* of the rotation preventing portion 14 is formed into a rectangular shape as a whole, and to study its cross section, the cross section has a pair of parallel short sides, and the pair of short sides are connected together by a single plate-shaped member which is disposed at a position where the plate-shaped member does not project from edges of the short sides (namely, the member does not project from the rectangular), so that the vicinity 4*b* of the rotation preventing portion 14 exhibits a shape which looks like a collapsed H-shape. Therefore, the vicinity 4*b* of the rotation preventing portion 14 is supported within the rectangular insertion hole 9 provided in the housing 1, whereby, as with the guide shaft portion 4*c*, an erroneous assemblage of the housing 1 is prevented, and the rotation of the housing 1 round the vicinity 4*b* of the rotation preventing portion 14 is also prevented, so that the housing 1 is slidably supported therealong.

Here, when looked at in FIG. 1, in the slide member 4, a right-hand side portion where the vicinity 4*a* of the driven portion 18 and the guide shaft portion 4*c* are provided and a left-hand side portion thereof where the vicinity 4*b* of the rotation preventing portion 14 is provided are in such a positional relationship that the right-hand side portion and the left-hand side portion are displaced relative to each other in a twisting direction, and the right-hand side portion and the left-hand side portion are molded into an integrated part in which they are connected together by an intermediate portion 4*d*. Since the vicinity 4*b* of the rotation preventing portion 14 is situated in a position which is rotated through 30° in a direction in which the latch 2 rotates from the released state to the locked state relative to the vicinity 4*a* of the driven portion 18 and the guide shaft portion 4*c*, the latch 2 can be provided in a position which results when an edge of the abutment lower end portion 2*a* which projects radially is rotated about 30° in a counterclockwise direction. Therefore, an extent of a connecting portion 2*b* which connects the abutment lower end portion 2*a* with the tongue piece 12B circumferentially integrally can be narrowed, whereby the latch 2 can be molded smaller and lighter while obtaining large strength and rigidity. This angle of about 30° functions not only to make the latch 2 small, light, strong and rigid but also to reduce colliding noise that is produced when the striker 26 is first brought into collision with the latch 2 during a closing operation of the lid. Consequently, this aspect of the embodiment becomes largely advantageous as the size of the glove box increases.

Since the lock system of the invention can be make up into the module, so as to facilitate the assemblage thereof, it will be remarkably convenient when the lock system is applied to a glove box that is mounted in an instrument panel of a motor vehicle in such a manner as to be opened and closed or an independent lid thereof.

What is claimed is:

1. A lock system comprising:

a latch that is rotatably supported on a housing and brought into engagement with and disengagement from a striker;

a spring for biasing the latch in a direction in which the engagement of the latch with the striker is released;

a slide member that is rotatably supported on the housing, controls a rotation of the latch, and comprises an integrated molded part which is molded from a synthetic resin;

a rotation preventing portion that prevents the rotation of the latch in a biased direction;

a rotation permitting portion that permits the rotation of the latch in the biased direction, the rotation preventing portion and the rotation permitting portion are provided at one end portion of the slide member;

a driven portion, provided at an other end portion of the slide member, that links with a manual operation unit;

an elastic locking portion that is insertable into an insertion hole in the housing and prevents a dislodgement of itself from the insertion hole;

an elastic arm which is partially cut apart from the one end portion of the slide member;

an arc-shaped guide surface relative to the insertion hole; and a vertical lock surface having an upwardly tapered shape, wherein the elastic locking portion is provided at the one end portion of the slide member, wherein the elastic locking portion comprises the elastic arm, wherein a front end edge of the elastic arm comprises the arc-shaped guide surface, and wherein a rear end edge of the elastic arm comprises the vertical lock surface.

2. A lock system comprising:

a latch that is rotatably supported on a housing and brought into engagement with and disengagement from a striker;

a spring for biasing the latch in a direction in which the engagement of the latch with the striker is released;

a slide member that is rotatably supported on the housing, controls a rotation of the latch, and comprises an integrated molded part which is molded from a synthetic resin;

a rotation preventing portion that prevents the rotation of the latch in a biased direction;

a rotation permitting portion that permits the rotation of the latch in the biased direction, the rotation preventing portion and the rotation permitting portion are provided at one end portion of the slide member; and a driven portion, provided at an other end portion of the slide member, that links with a manual operation unit, wherein the slide member is molded into a beam shape that exhibits a substantially rectangular cross section, and wherein the cross section is twisted midway along the length of the slide member in such a manner that the cross section located in a vicinity of the rotation preventing portion is twisted in a direction in which the latch rotates from a released state to a locked state relative to the cross section in a vicinity of the driven portion.

* * * * *